US007032690B2

(12) United States Patent
Ramey et al.

(10) Patent No.: US 7,032,690 B2
(45) Date of Patent: Apr. 25, 2006

(54) APPARATUS AND METHOD FOR VISUALLY DETECTING WEAR TO INSERT BOWLS, BUSHINGS, AND SPIDERS

(75) Inventors: Joe Stewart Ramey, Youngsville, LA (US); Jeremy Michael Louviere, New Iberia, LA (US)

(73) Assignee: Access Oil Tools, Inc., Broussard, LA (US)

( * ) Notice: Subject to any disclaimer, the term of this patent is extended or adjusted under 35 U.S.C. 154(b) by 278 days.

(21) Appl. No.: 10/661,434

(22) Filed: Sep. 12, 2003

(65) Prior Publication Data

US 2005/0056420 A1 Mar. 17, 2005

(51) Int. Cl.
*E21B 19/10* (2006.01)

(52) U.S. Cl. ..... 175/57; 175/423; 166/88.2; 188/67

(58) Field of Classification Search ..... 175/423, 175/57; 188/67; 166/75.14, 85.3, 88.2, 166/89.3
See application file for complete search history.

(56) References Cited

U.S. PATENT DOCUMENTS 1,900,714 A * 3/1933 Humason et al. ..... 285/123.12
3,156,026 A * 11/1964 Kelley ..... 175/423
3,225,833 A * 12/1965 Parkhurst ..... 166/207
3,270,389 A * 9/1966 Kingsbury ..... 188/67
3,348,277 A * 10/1967 Crickmer ..... 175/423
3,811,709 A 5/1974 McGee et al.
4,332,062 A 6/1982 Byrne, Jr.
4,416,340 A 11/1983 Bailey
4,480,703 A 11/1984 Garrett
5,335,756 A * 8/1994 Penisson ..... 188/67
5,351,767 A 10/1994 Stogner et al.
6,354,380 B1 3/2002 Becnel et al.
6,471,439 B1 10/2002 Allamon et al.
2002/0061224 A1 5/2002 Allamon et al.

* cited by examiner

*Primary Examiner*—David Bagnell
*Assistant Examiner*—Shane Bomar
(74) *Attorney, Agent, or Firm*—C. Dean Domingue; Robert L. Waddell; Ted A. Anthony

(57) ABSTRACT

An insert bowl, bushing, or spider includes a bowl having a central bore defined by an inner surface having an upper tapered section for engaging slips supporting a work string and a lower section. A wear indicator, such as a groove or substantially horizontal groove, is formed in the inner surface of the bowl and provides a visual indicator of wear to the bowl. A second wear indicator, such as a groove or substantially horizontal groove, may also be formed in the inner surface of the bowl. The inability to visually detect all or a portion of the wear indicator signifies that maximum recommended wear to the bowl has been reached and the bowl should be replaced to avoid damage to the work string.

2 Claims, 4 Drawing Sheets

APPARATUS AND METHOD FOR VISUALLY DETECTING WEAR TO INSERT BOWLS, BUSHINGS, AND SPIDERS

FIELD OF THE INVENTION

The present invention relates to improved insert bowls, bushings, and spiders that are used in oilfield operations to engage slips that support a work string in a vertical position, and more particularly, to insert bowls, bushings, and spiders having a bowl with wear indicator means to visually detect wear to an inner surface of the bowl. The present invention also relates to an improved method of visually detecting wear to insert bowls, bushings, and spiders.

BACKGROUND OF THE INVENTION

Suspension assemblies are used in oilfield operations to hold and support a work string, (e.g., a tubular such as drill pipe) in a vertical position above the rig floor to enable the addition to or removal of a joint or section of the work string from the upper end thereof. These assemblies may include insert bowls, bushings, or spiders, each comprising a bowl with a central bore through which the work string extends. The central bore of the bowl is defined by an inner surface. The inner surface is usually tapered so that the diameter of the upper section of the central bore is greater than the diameter of the lower section of the central bore. An example of a bowl is described in U.S. Pat. No. 4,332,062 and in U.S. Pat. No. 5,351,767.

A slip assembly may also form part of the suspension assembly. The slip assembly may have multiple slips with an inner surface designed to grip the work string when the slip assembly is secured to a section of the outer wall of the work string. The outer surface of the slips have a tapered contour that is designed to mate with and engage the corresponding tapered inner surface of the bowl when the slip assembly (with secured work string) is situated within the bore of the bowl. An example of a slip assembly is described in U.S. Pat. No. 6,471,439 and in U.S. patent application Publication No. 2002/0061224.

A rotary table may also be included as part of the suspension assembly. The rotary table is mounted to the floor of the rig. The rotary table has a contoured bore that is designed to accommodate an insert bowl, bushing, or spider. An example of a rotary table is described in U.S. Pat. No. 6,471,439.

To suspend and hold the work string using the suspension assembly, the rotation of the work string is stopped. The slip assembly is positioned around a section of the outer wall of the work string. The slip assembly (together with the attached work string) is lowered into the bore of the bowl where the slip assembly is wedged therein as the tapered outer surface of the slips engage the tapered inner surface of the bowl. The wedging of the slip assembly in the bowl causes the slips to further exert pressure against the work string to grip and hold the work string in a vertical, suspended position above the rig floor so additional joints or sections can be added to or removed from the work string.

Repeated use of the suspension assembly may cause wear and fatigue to the components, particularly the bowl and slips which are prone to wear as a result of the metal-to-metal abrasive contact between them. In addition, the work string may contact the bowl on occasion during drilling operations and cause further wear to the bowl, namely to the inner surface area. The section of the inner surface of the bowl at the bottom of the taper (referred to as the throat) is particularly vulnerable and subject to degradation because this is where the greatest load is placed and where the work string tends to make contact.

FIG. 1 shows what can happen to a bowl that is worn beyond design specifications for desired use. Bowl 11 exhibits wear 28 to inner surface 16, namely to lower section 18 of inner surface 16.

Because of wear 28 to inner surface 16 of bowl 11, bowl 11 does not adequately support slips 13, particularly in area 34 where outer surface 33 of slips 13 no longer contacts or engages inner surface 16 of bowl 11. This loss of contact and support in area 34 of inner surface 16 of bowl 11 means that the gripping force applied to work string 14 by slips 13 is no longer evenly distributed but instead is concentrated in area 29 of work string 14. The concentration of force in area 29 may cause bottlenecking of work string 14 at area 30 as well as crushing of or excessive slip cuts in work string 14.

Due to the spreading of lower section 31 of slips 13 and the loss of contact between lower section 31 of slips 13 and work string 14 at area 32, the gripping area of slips 13 is reduced, which may result in slips 13 failing to hold and support work string 14.

Insert bowls, bushings, and spiders are manufactured in accordance with applicable standards set by the American Petroleum Institute (API). For example, API specifications require a new number 3 bowl to have a throat diameter (diameter of area at the bottom of the taper) of 10⅛ inches. Generally, the industry practice is to replace the bowl when the maximum wear as measured at the throat of the bowl reaches 10⅝ inches to 10⅞ inches.

To determine if the dimensions of the throat of the bowl exceed 10⅝ inches, it is necessary to measure the diameter of the throat of the bowl using mechanical calipers. Such measurement by hand using a caliper is difficult because of the tapered contour of the inner surface of the bowl, which may lead to an incorrect measurement.

If the bowl is positioned in a rotary table, the bowl must first be removed before a measurement can be taken. Removing the bowl from the rotary table is a time consuming and difficult procedure. Any work string extending through the bowl will need to be dismantled and removed if the bowl is of a single-piece design and does not have separate detachable components.

Even if the bowl is a split bowl having two detachable components, maneuvering the bowl components from the rotary table to a level surface and reassembling them for measurement is troublesome as the components are awkwardly shaped and heavy making them difficult to manipulate. Moreover, properly aligning the bowl components in their operational position outside of the rotary table is problematic. An incorrect alignment may lead to an error in the measurement of the throat diameter.

U.S. Pat. No. 6,354,380 describes an insert bowl for use with a wireline. The insert bowl has a vertical groove formed in the inner surface of the bowl. The vertical groove positions and contains the wireline that is run down through the bore of the insert bowl. The vertical groove does not function as a wear indicator means to visually inspect wear to the insert bowl.

The foregoing disadvantages and problems of detecting wear to an insert bowl, bushing, or spider are overcome by the apparatus and method of the present invention wherein a wear indicator means formed in the inner surface of the bowl enables visual detection of wear so that the bowl can be replaced before damage is caused to the work string.

SUMMARY OF INVENTION

It is an object of the present invention to provide a safe and easy means to detect wear to an insert bowl, bushing, or spider.

It is a further object of the present invention to provide a means to detect wear to an insert bowl, bushing, or spider that does not require the use of calipers.

It is a further object of the present invention to provide a means to detect wear to an insert bowl, bushing, or spider without the necessity of removing the insert bowl, bushing, or spider from a rotary table.

It is a further object of the present invention to provide a means to visually detect wear to an insert bowl, bushing, or spider.

It is a further object of the present invention to provide a means to visually detect degrees of wear to an insert bowl, bushing, or spider.

It is a further object of the present invention to provide a method to visually detect wear to an insert bowl, bushing, or spider.

The objects and advantages of the present invention are achieved by providing an apparatus for visually detecting wear to an insert bowl, bushing, or spider. The apparatus preferably includes a bowl having a central bore defined by an inner surface. The inner surface preferably has an upper tapered section for engaging slips supporting a work string and a lower section.

A wear indicator means is preferably formed in the inner surface of the bowl. Preferably, the wear indicator means is formed in the lower section of the inner surface of the bowl, and more preferably at or near the throat of the bowl (the area defined by the bottom of the taper). The wear indicator means provides a visual indicator of wear to the inner surface of the bowl.

When the wear indicator means (or a portion thereof) is no longer visible, this indicates that the inner surface of the bowl has reached the maximum recommended wear and the bowl should be replaced in order to prevent damage to the work string. Because the wear indicator means provides a visual means to detect wear, there is no longer any need or requirement to measure the throat of the bowl with a caliper to determine if the diameter of the throat exceeds the recommended maximum dimensions of 10⅝ inches. Wear to the inner surface of the bowl can be visually inspected and detected by sight alone.

Nor is there a need to remove the bowl from the rotary table and reassemble it (if it is a split bowl with two detachable components) in order to take a measurement. The bowl can remain in the rotary table where visual inspection and detection of wear can be accomplished by seeing if the wear indicator means is still visible either partially or entirely.

In accordance with the apparatus of the present invention, the wear indicator means is preferably a groove. More preferably, the groove is a substantially horizontal groove. It is also preferred if the substantially horizontal groove extends around the circumference of the inner surface of the bowl and more preferably around the circumference of the inner surface of the bowl at or near the throat of the bowl at the bottom of the taper.

The groove preferably has an initial non-wear depth. The initial non-wear depth may be any depth. However, it is preferred if the groove has an initial non-wear depth of at least ¼ inch. It is to be understood that the depth of the initial non-wear depth of the groove is dependent upon the weight of the work string being run as well as the industry practice for recommended maximum wear to the particular type and size of insert bowl, bushing, or spider being used. For example, if a heavy work string is being run, the initial non-wear depth might be less than ¼ inch.

In another embodiment of the apparatus of the present invention, a second wear indicator means may be formed in the inner surface of the bowl. Preferably, the second wear indicator means is a groove, and more preferably, a substantially horizontal groove. The embodiment therefore may have a first substantially horizontal groove and a second substantially horizontal groove each formed in the inner surface of the bowl.

It is preferred if the first substantially horizontal groove has an initial non-wear depth that is less than an initial non-wear depth of the second substantially horizontal groove. For example, the initial non-wear depth of the first substantially horizontal groove may be ⅛ inch while the initial non-wear depth of the second substantially horizontal groove may be ¼ inch. By having first and second substantially horizontal grooves formed in the inner surface of the bowl, two visual indicators of degrees or varying extent of wear to the bowl are provided.

For example, the depth of the initial non-wear depth of the first substantially horizontal groove may indicate, when no longer visually detectable in whole or in part, the early stages of wear to the inner surface of the bowl or non-excessive wear, meaning that replacement of the bowl is not indicated or necessary but that wear is present and should be closely monitored. The depth of the second substantially horizontal groove (which is greater than the initial non-wear depth of the first substantially horizontal groove) may be indicative, when no longer visible in whole or in part, of progressive wear to the inner surface of the bowl signifying that recommended maximum wear has been reached and replacement of the bowl is necessary.

It is also preferred if the first substantially horizontal groove is formed in the upper tapered section of the inner surface of the bowl, and the second substantially horizontal groove is formed in the lower section of the inner surface of the bowl. First and second substantially horizontal grooves may each be formed in the lower section of the inner surface of the bowl. If formed in the lower section of the bowl, it is preferred that first substantially horizontal groove and/or second substantially horizontal groove be formed at the throat of the bowl at or near the bottom taper in the inner surface thereof.

The present invention is also directed to new and useful methods of making and using the apparatus described above to visually detect wear to an insert bowl, bushing, or spider. The method may include the step of using the apparatus described above to visually inspect the wear indicator means to determine if wear exists in the inner surface of the bowl. If all or part of the wear indicator means is not visible, this indicates recommended maximum wear to the bowl has been reached and the bowl should be replaced in order to prevent damage to the work string.

DETAILED DESCRIPTION OF PREFERRED EMBODIMENTS

Figure 1:
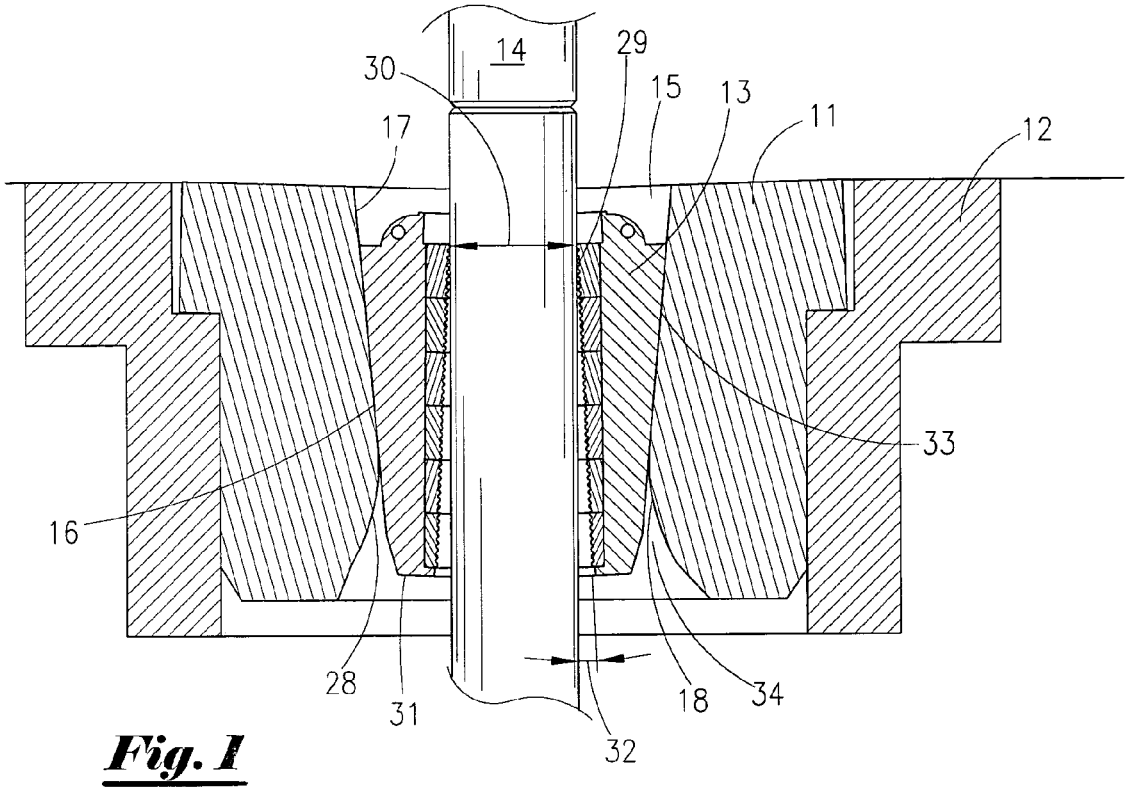
Fig. 1 PRIOR ART
FIG. 1 is a sectional view of a prior art suspension assembly exhibiting wear.
Figure 2:
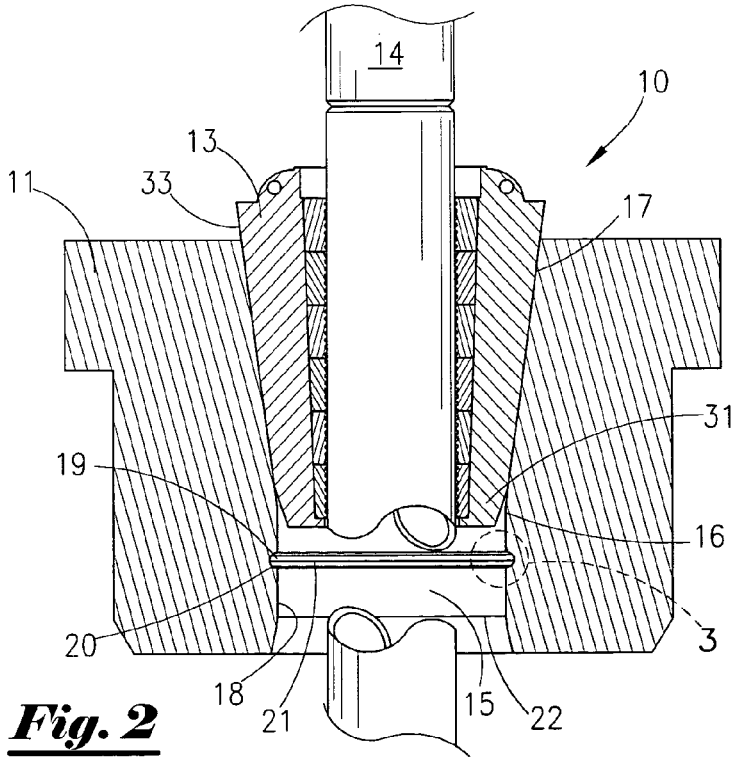
FIG. 2 is a partial cut-out, sectional view of an embodiment of the bowl of the present invention exhibiting non-wear.

With reference to the figures where like elements have been given like numerical designation to facilitate an understanding of the present invention, and particularly with reference to the embodiment of the present invention illustrated in FIG. 2, the present invention is an apparatus 10 for visually detecting wear to an insert bowl, bushing, or spider. Apparatus 10 preferably includes bowl 11 having central bore 15 defined by inner surface 16. Inner surface 16 may have upper tapered section 17 for engaging slips 13 supporting work string 14 and lower section 18.

With reference to FIG. 2, wear indicator means 19 preferably is formed in inner surface 16 of bowl 11. Wear indicator means 19 provides a visual indicator of wear to inner surface 16 of bowl 11.

Again with reference to FIG. 2, wear indicator means 19 preferably is groove 20. Groove 20 is preferably substantially horizontal groove 21. It is preferred if substantially horizontal groove 21 extends around circumference 22 of inner surface 16 of bowl 11.

FIG. 2 also shows that wear indicator means 19 (which may preferably be groove 20 or substantially horizontal groove 21) is preferably formed in lower section 18 of inner surface 16 of bowl 11.

Figure 3:
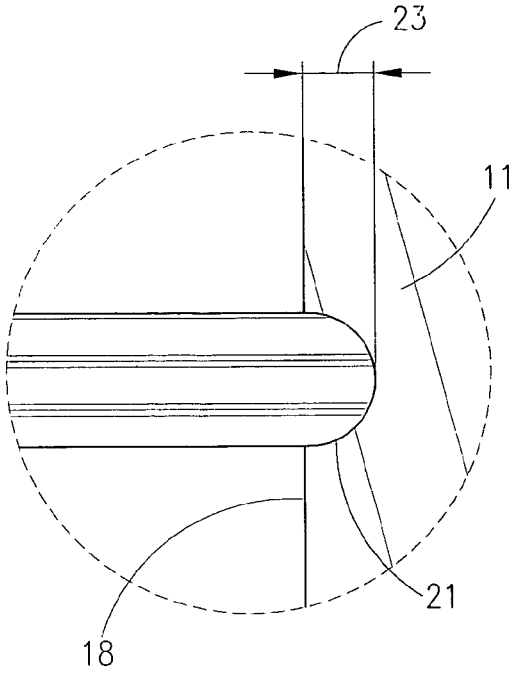
FIG. 3 is an enlarged view of a section of the embodiment of the bowl of the present invention shown in FIG. 2.

With reference to FIG. 3, substantially horizontal groove 21 may have initial non-wear depth 23 of at least ¼ inch.

Figure 4:
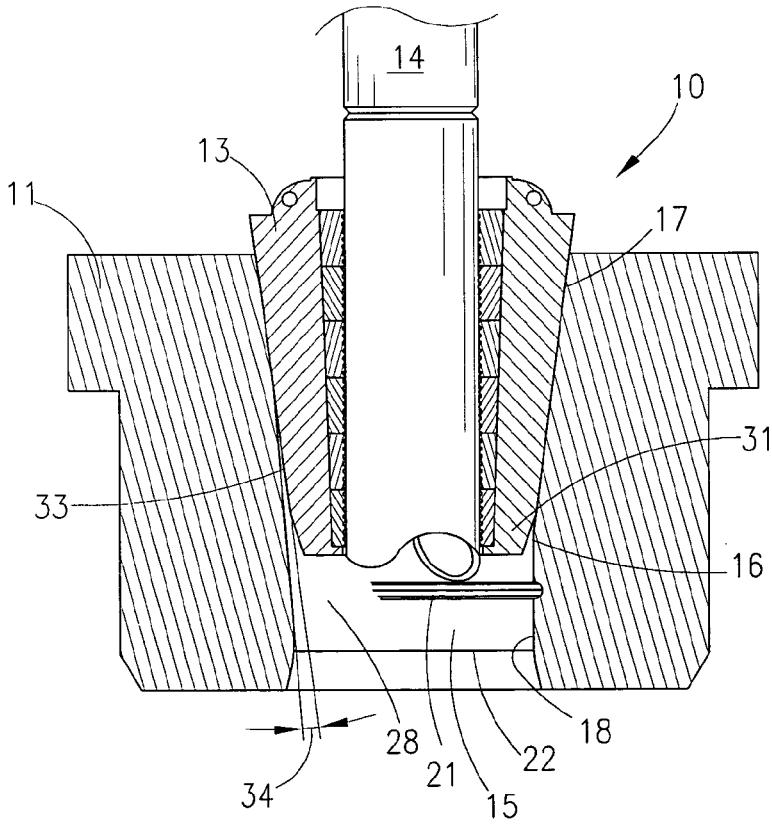
FIG. 4 is a partial cut-out, sectional view of an embodiment of the bowl of the present invention exhibiting partial wear.

As shown in FIG. 4, substantially horizontal groove 21 is partially degraded and not visible in area 28 of lower section 18 of inner surface 16 of bowl 11. This indicates wear to inner surface 16 of bowl 11 and that bowl 11 should be replaced if damage to work string 14 is to be avoided. The inability to visually detect all or a portion of substantially horizontal groove 21 means that the diameter of central bore 15 is at or has exceeded recommended maximum wear to bowl 11 (namely inner surface 16 of bowl 11) and that bowl 11 should be replaced.

Figure 5:
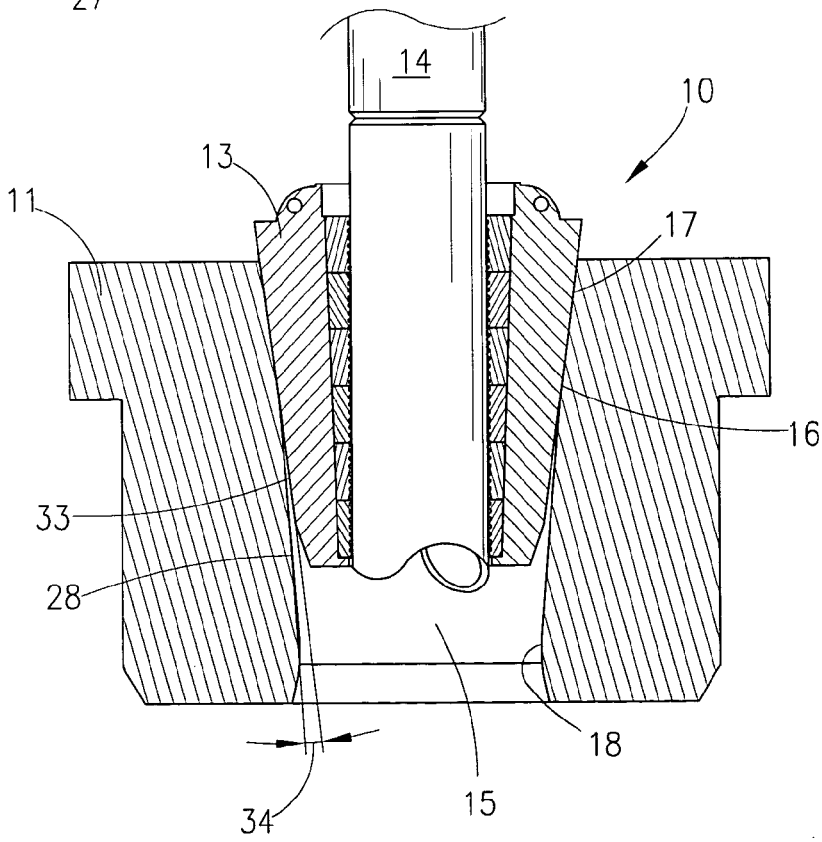
FIG. 5 is a partial cut-out, sectional view of an embodiment of the bowl of the present invention exhibiting wear.

As seen in FIG. 5, degradation of substantially horizontal groove 21 in area 28 of lower section 18 of inner surface 16 of bowl 11 results in all of substantially horizontal groove 21 not being visible. The inability to visually detect substantially horizontal groove 21 means that central bore 15 is at or has exceeded recommended maximum wear to bowl 11 (namely inner surface 16 of bowl 11) and that bowl 11 should be replaced if damage to work string 14 or slips 13 is to be avoided.

Figure 6:
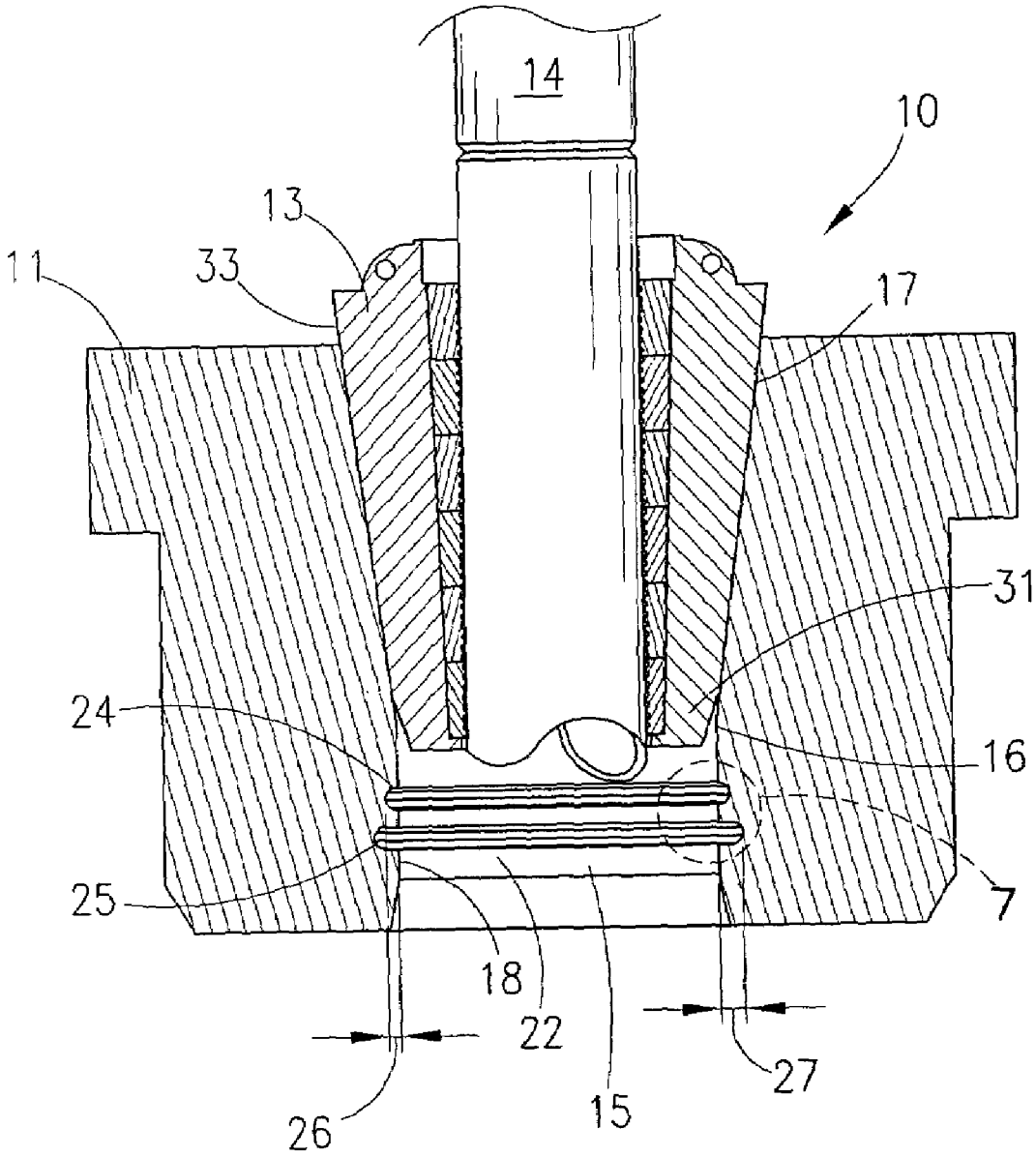
FIG. 6 is a partial cut-out, sectional view of another embodiment of the bowl of the present invention exhibiting non-wear.

With reference to FIG. 6, an alternative embodiment of the apparatus 10 of the present invention is shown. In the alternative embodiment, bowl 11 has a central bore 15 defined by inner surface 16. Inner surface 16 of bowl 11 may include upper tapered section 17 for engaging slips 13 supporting work string 14, lower section 18, first substantially horizontal groove 24, and second substantially horizontal groove 25. First and second substantially horizontal grooves 24, 25 may be formed in inner surface 16 of bowl 11. First and second substantially horizontal grooves 24, 25 may provide visual indicators of wear to inner surface 16 of bowl 11.

Figure 7:
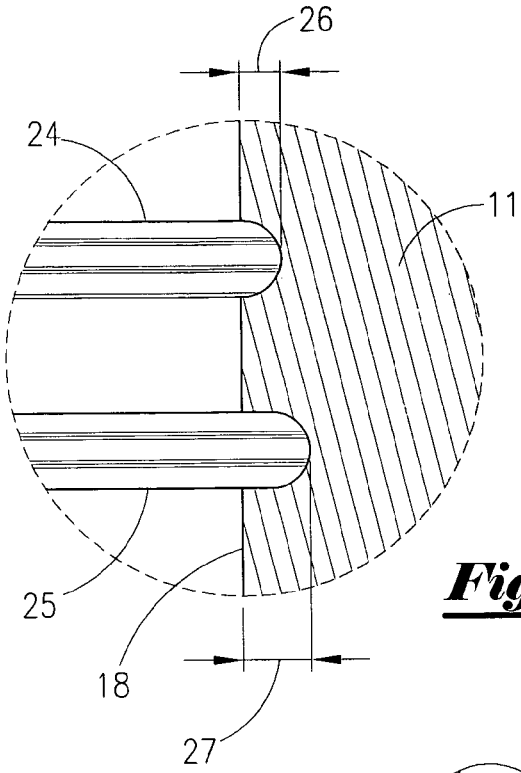
FIG. 7 is an enlarged view of a section of the embodiment of the bowl of the present invention shown in FIG. 6.

As shown in FIGS. 6 and 7, it is preferred if first substantially horizontal groove 24 has initial non-wear depth 26 less than initial non-wear depth 27 of second substantially horizontal groove 25.

It is also preferred if first substantially horizontal groove 24 is formed in upper tapered section 17 of inner surface 16 of bowl 11 and second substantially horizontal groove 25 is formed in lower section 18 of inner surface 16 of bowl 11. More preferably, first and second substantially horizontal grooves 24, 25 are formed in lower section 18 of inner surface 16 of bowl 11. First and second substantially horizontal grooves 24, 25 may each have the same initial non-wear depth, which may be at least ¼ inch. However, as stated above, it is preferred if first and second substantially horizontal grooves 24, 25 have different non-wear depths 26, 27. As for example, initial non-wear depth 26 of first substantially horizontal groove 24 may be at least ¼ inch while initial non-wear depth 27 of second substantially horizontal groove 25 may be at least ½ inch. By varying the initial non-wear depths 26, 27, degrees or extent of wear to inner surface 16 of bowl 11 may be observed and detected on an interval basis.

The degradation of first substantially horizontal groove 24 having initial non-wear depth 26 so that first substantially horizontal groove 24 is not visible, in whole or in part, may be indicative of the early stages of wear to inner surface 16 of bowl 11 that does not require replacement of bowl 11. But, as bowl 11 is further used and wear to inner surface 16 of bowl 11 increases, degradation of second substantially horizontal groove 25 having initial non-wear depth 27 may occur. The inability to visually detect second substantially horizontal groove 25 in whole or in part, may be indicative of the progressive wear to inner surface 16 of bowl 11 wherein the diameter of central bore 15 is at or has exceeded recommended maximum wear to bowl 11 (namely inner surface 16 of bowl 11) and that bowl 11 should be replaced in order to prevent damage to work string 14.

The present invention is also directed to a method of visually detecting wear to an insert bowl, bushing, or spider. The method preferably includes the step of providing a bowl 11 having a central bore 15 defined by inner surface 16. Preferably, inner surface 16 includes upper tapered section 17 for engaging slips 13 supporting work string 14, lower section 18, and wear indicator means 19. It is preferred if wear indicator means 19 is formed in inner surface 16 of bowl 11. Wear indicator means 19 may provide a visual indicator of wear to inner surface 16 of bowl 11.

The method of the present invention also includes the step of visually inspecting wear indicator means 19 for existence of wear to inner surface 16 of bowl 11. The inability to visually detect wear indicator means 19 (or a portion thereof) in inner surface 16 of bowl 11 signifies wear to inner surface 16 of bowl 11 and that bowl 11 should be replaced. Specifically, the inability to visually detect all or a portion of wear indicator means 19 means that the diameter of central bore 15 is at or has exceeded recommended maximum wear to bowl 11 (namely inner surface 16 of bowl 11) and that bowl 11 should be replaced.

It is preferred if bowl 11 used in the method of the present invention includes wear indicator means 19 that is formed in lower section 18 of inner surface 16 of bowl 11. It is also preferred if wear indicator means 19 is groove 20. More preferably, groove 20 is substantially horizontal groove 21, which may extend around circumference 22 of inner surface 16 of bowl 11. Preferably, groove 20 or substantially horizontal groove 21 is machined in inner surface 16 of bowl 11. Preferably, groove 20 or substantially horizontal groove 21 is machined to an initial non-wear depth 23 of at least ¼ inch.

In an alternative method of the present invention, bowl 11 has a central bore 15 defined by inner surface 16. Inner surface 16 preferably includes upper tapered section 17 for engaging slips 13 supporting work string 14, lower section 18, first substantially horizontal groove 24, and second substantially horizontal groove 25. Preferably, first and second substantially horizontal grooves 24, 25 are each formed in inner surface 16 of bowl 11 and preferably provide visual indicators of wear to inner surface 16 of bowl 11.

The alternative embodiment of the method of the present invention may include the step of visually inspecting first and second substantially horizontal grooves 24, 25 for existence of wear to inner surface 16 of bowl 11.

It is preferred if first substantially horizontal groove 24 has initial non-wear depth 26 less than initial non-wear depth 27 of second substantially horizontal groove 25.

In the alternative embodiment of the method of the present invention, the inability to visually detect first substantially horizontal groove 24 signifies the early stages of wear to inner surface 16 of bowl 11 that does not require the replacement of bowl 11. The inability to visually detect second substantially horizontal groove 25 signifies progressive wear to inner surface 16 of bowl 11 wherein the diameter of central bore 15 is at or has exceeded recommended maximum wear to bowl 11 (namely inner surface 16 of bowl 11) and that bowl 11 should be replaced to avoid damage to work string 14.

It is preferred that in the alternative embodiment of the method of the present invention, first substantially horizontal groove 24 is formed in upper tapered section 17 of inner surface 16 of bowl 11 and second substantially horizontal groove 25 is formed in lower section 18 of inner surface 16 of bowl 11. More preferably, first and second substantially horizontal grooves 24, 25 are each formed in lower section 18 of inner surface 16 of bowl 11. First and second substantially horizontal grooves 24, 25 are preferably machined into inner surface 16 of bowl 11.

While preferred embodiments of the present invention have been described, it is to be understood that the embodiments described are illustrative only and that the scope of the invention is to be defined only by the appended claims when accorded at a full range of equivalence, many variations and modifications naturally occurring to those skilled in the art from a perusal hereof.

What is claimed is:

1. A method of visually detecting wear to an insert bowl, comprising the steps of:

a) providing a bowl having a central bore defined by an inner surface, said inner surface including an upper tapered section for engaging slips supporting a work string, a lower section, a first substantially horizontal groove, and a second substantially horizontal groove, said first and second horizontal grooves each being formed in the inner surface of said bowl and providing a visual indicator of wear to the inner surface of said bowl; and b) visually inspecting said first and second substantially horizontal grooves for existence of wear to the inner surface of said bowl; wherein said first substantially horizontal groove has an initial non-wear depth less than an initial non-wear depth of said second substantially horizontal groove and wherein an inability to visually detect at least a portion of said first substantially horizontal groove signifies wear to the inner surface of said bowl that does not indicate that replacement of said bowl is necessary and an inability to detect at least a portion of said second substantially horizontal groove signifies wear to the inner surface of said bowl that indicates that replacement of said bowl is necessary.

2. The method according to claim 1, wherein said first and second substantially horizontal grooves are each formed in the lower section of the inner surface of said bowl.

* * * * *